US009719380B2

(12) United States Patent
Hissong et al.

(10) Patent No.: US 9,719,380 B2
(45) Date of Patent: Aug. 1, 2017

(54) POWER GENERATION USING NON-AQUEOUS SOLVENT

(71) Applicants: Douglas W. Hissong, Cypress, TX (US); O. Angus Sites, Spring, TX (US)

(72) Inventors: Douglas W. Hissong, Cypress, TX (US); O. Angus Sites, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 149 days.

(21) Appl. No.: 14/368,160

(22) PCT Filed: Nov. 16, 2012

(86) PCT No.: PCT/US2012/065659
§ 371 (c)(1),
(2) Date: Jun. 23, 2014

(87) PCT Pub. No.: WO2013/103447
PCT Pub. Date: Jul. 11, 2013

(65) Prior Publication Data

US 2014/0366539 A1 Dec. 18, 2014

Related U.S. Application Data

(60) Provisional application No. 61/582,592, filed on Jan. 3, 2012.

(51) Int. Cl.

| | |
|---|---|
| ***F01K 15/00*** | (2006.01) |
| ***F01K 25/08*** | (2006.01) |
| ***C10G 1/04*** | (2006.01) |
| ***F01K 25/02*** | (2006.01) |
| ***F01K 27/02*** | (2006.01) |

(52) U.S. Cl.
CPC ..... *F01K 15/00* (2013.01); *C10G 1/045* (2013.01); *F01K 25/02* (2013.01); *F01K 25/08* (2013.01); *F01K 27/02* (2013.01)

(58) Field of Classification Search
CPC ..... F01K 15/00; F01K 27/02; F01K 25/02; F01K 25/08; C10G 1/045
USPC ..... 60/649, 673, 651, 671
See application file for complete search history.

(56) References Cited

U.S. PATENT DOCUMENTS

| | | | | |
|---|---|---|---|---|
| 3,856,474 A | 12/1974 | Pittman et al. | ..... | 23/267 R |
| 4,197,183 A | 4/1980 | Audeh | ..... | 208/11 LE |
| 4,408,459 A | 10/1983 | Yogev | ..... | 60/641.8 |

(Continued)

FOREIGN PATENT DOCUMENTS

| | | | | |
|---|---|---|---|---|
| CA | 2729457 | 7/2011 | ..... | C10C 3/08 |
| EP | 0757091 | 2/1997 | ..... | C10L 1/00 |

(Continued)

*Primary Examiner* — Hoang Nguyen
(74) *Attorney, Agent, or Firm* — ExxonMobil Upstream Research Company Law Department

(57) ABSTRACT

A system and methods for power generation uses non-aqueous solvent. The method includes treating oil sands with a non-aqueous solvent to extract bitumen in an extraction process and separating the non-aqueous solvent from the bitumen in a solvent recovery process. The method also includes heating the non-aqueous solvent, expanding the non-aqueous solvent to generate power, and cooling the non-aqueous solvent. The method further includes recycling at least a portion of the non-aqueous solvent to the extraction process.

25 Claims, 6 Drawing Sheets

(56) References Cited

U.S. PATENT DOCUMENTS

| | | | | |
|---|---|---|---|---|
| 4,532,024 | A | 7/1985 | Haschke et al. | 208/11 LE |
| 4,760,705 | A | 8/1988 | Yogev | 60/651 |
| 5,551,238 | A | 9/1996 | Prueitt | 60/643 |
| 5,843,302 | A | 12/1998 | Hood | 208/309 |
| 6,969,123 | B2 * | 11/2005 | Vinegar | E21B 43/006 166/302 |
| 2008/0135241 | A1 * | 6/2008 | Iqbal | F22B 1/22 166/266 |
| 2010/0170453 | A1 * | 7/2010 | Betzer-Zilevitch | B03D 1/02 122/6 R |
| 2010/0175876 | A1 | 7/2010 | Speirs et al. | 166/272.1 |
| 2010/0275600 | A1 | 11/2010 | Speirs et al. | 60/670 |
| 2010/0307959 | A1 * | 12/2010 | Hong | C10G 1/047 208/391 |
| 2011/0094937 | A1 * | 4/2011 | Subramanian | C10G 21/003 208/40 |
| 2012/0138511 | A1 * | 6/2012 | Kimball | B03B 9/02 208/391 |

FOREIGN PATENT DOCUMENTS

| | | | |
|---|---|---|---|
| WO | WO2007/104970 | 9/2007 | |
| WO | WO2011/081734 | 7/2011 | C10G 1/04 |
| WO | WO2011/082209 | 7/2011 | C10G 1/00 |

* cited by examiner

100

200

300

400

500

600

POWER GENERATION USING NON-AQUEOUS SOLVENT

CROSS REFERENCE TO RELATED APPLICATIONS

This application is the National Stage of International Application No. PCT/US2012/065659, filed Nov. 16, 2012, which claims the priority benefit of U.S. Patent Application No. 61/582,592 filed Jan. 3, 2012 entitled POWER GENERATION USING NON-AQUEOUS SOLVENT, the entirety of which is incorporated by reference herein.

FIELD

Exemplary embodiments of the subject innovation relate to the extraction of bitumen from oil sands and the generation of power using non-aqueous solvent.

BACKGROUND

Hydrocarbon-containing materials, such as oil sands, often contain bitumen, which is an oily, highly-viscous liquid or semi-solid. Bitumen is a naturally-occurring organic byproduct of decomposed organic material. An extraction process is performed on the hydrocarbon-containing materials in order to harvest the bitumen for sale.

There are many upstream and downstream processes that involve circulating large volumes of solvent to effect a separation of a hydrocarbon-containing stream from a hydrocarbon-containing material or to clean up a hydrocarbon stream by removing high molecular weight hydrocarbons. However, such processes often consume a large amount of power. In addition, the large amount of recycle solvent that is sent through such processes adds to the already-high power demands. Oftentimes, a certain amount of power may be generated for these processes by burning some of the hydrocarbon product that is obtained. However, this method of producing power results in the loss of a certain amount of hydrocarbon product that might otherwise have been sold. Thus, research has to been performed to improve energy usage and find synergies for the generation of energy.

U.S. Pat. No. 5,843,302 to Hood discloses a solvent deasphalting apparatus capable of generating power. The solvent deasphalting apparatus includes a separator that receives two inputs, a heavy hydrocarbon feed and a solvent feed, and produces two outputs, an asphaltene/solvent stream and a deasphalted oil/solvent stream. A solvent recovery unit recovers the solvent stream, which is returned to a solvent drum. A pump is used to pump a relatively constant volume of solvent from the solvent drum into a by-pass line connecting the pump to the separator. A power generator is used to generate power in response to the flow of the solvent stream in the by-pass line. The power generator includes a vaporizer, an organic vapor turbine, a condenser, and a pump.

U.S. Pat. No. 4,760,705 to Yogev, et al., discloses a Rankine cycle power plant operating with an improved organic working fluid. The working fluid may be any of a number of different compounds, including, for example, bicyclic aromatic hydrocarbons, substituted bicyclic aromatic hydrocarbons, or heterobicyclic aromatic hydrocarbons. Such compounds are inherently stable in the temperature range of interest for the Rankine cycle power plant. More specifically, the molecular weight of such compounds is less than the molecular weight of many conventional working fluids and, thus, results in a lower Mach number at the turbine exit, thereby increasing the efficiency of the turbine.

International Patent Publication No. WO2007/104970 by Smith discloses a method for working fluid control in non-aqueous vapor power systems. Power is generated from heat from a source, and the heat is used to boil a non-aqueous working fluid by heat exchange in a boiler. Wet vapor from the boiler is fed by a line to a positive displacement twin-screw expander. The expanded fluid is fed by a line to a condenser and then returned to the boiler by a feed pump. The flow rate through the boiler and the expander is controlled by a controller responsive to pressure and temperature sensors monitoring a flow through a chamber to control the dryness of the fluid in the line, and lubricant for the expander may be included in the liquid phase.

SUMMARY

An embodiment provides a method for power generation using non-aqueous solvent. The method includes treating oil sands with a non-aqueous solvent to extract bitumen in an extraction process and separating the non-aqueous solvent from the bitumen in a solvent recovery process. The method also includes heating the non-aqueous solvent, expanding the non-aqueous solvent to generate power, and cooling the non-aqueous solvent. The method further includes recycling at least a portion of the non-aqueous solvent to the extraction process.

Another embodiment provides a system for power generation using non-aqueous solvent. The system includes an extraction unit configured to extract bitumen from oil sands by treating the oil sands with a non-aqueous solvent and a solvent recovery unit configured to separate the non-aqueous solvent from the bitumen. The system also includes a first heat exchanger configured to heat the non-aqueous solvent, an expander configured to generate power by turning an expander turbine using the non-aqueous solvent, and a second heat exchanger configured to cool the non-aqueous solvent.

Another embodiment provides a method for power generation using non-aqueous solvent. The method includes extracting bitumen from oil sands by treating the oil sands with a non-aqueous solvent and recovering the non-aqueous solvent by separating the non-aqueous solvent from the bitumen. The method also includes heating the non-aqueous solvent to produce a dry vapor, decreasing the pressure of the dry vapor to obtain an expanded dry vapor, and generating power from the expanded dry vapor. The method further includes cooling the dry vapor to recover the non-aqueous solvent.

DESCRIPTION OF THE DRAWINGS

The advantages of the present techniques are better understood by referring to the following detailed description and the attached drawings, in which.

DETAILED DESCRIPTION

Figure 1:
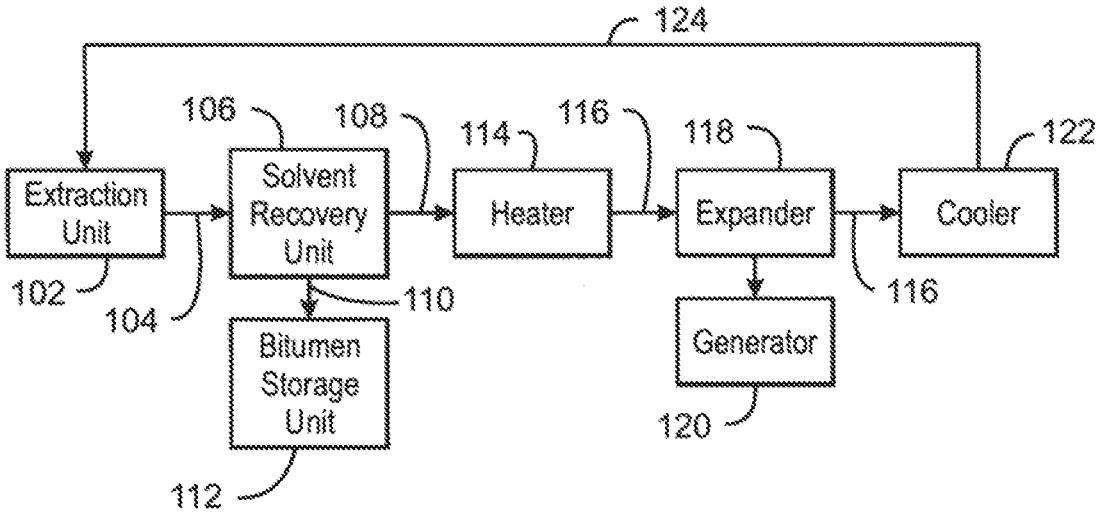
FIG. 1 is a block diagram of a system that may be used to extract bitumen from oil sands using an extraction process.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

A "facility" as used herein is a representation of a tangible piece of physical equipment through which hydrocarbon fluids are either produced from a reservoir or injected into a reservoir. In its broadest sense, the term facility is applied to any equipment that may be present along the flow path between a reservoir and the destination for a hydrocarbon product. Facilities may comprise drilling platforms, production platforms, production wells, injection wells, well tubulars, wellhead equipment, gathering lines, manifolds, pumps, compressors, separators, surface flow lines, and delivery outlets. In some instances, the term "surface facility" is used to distinguish those facilities other than wells. A "facility network" is the complete collection of facilities that are present in the model, which would include all wells and the surface facilities between the wellheads and the delivery outlets.

A "production facility" refers to one or more structures for carrying out activities on an inlet or an outlet of a production line. The production facility may be a floating vessel located over or near a subsea production well, such as an FPSO (floating, production, storage, and offloading vessel), an offshore fixed structure platform with production capabilities, an onshore structure with production capabilities, or the like. A production facility may be used to separate the liquids and gases obtained from production wells. Production facilities often include equipment for produced fluid heating, measurement, storage, pumping, or compression. Such facilities may also include equipment for the separation of liquids and gases. Moreover, such facilities may include equipment for the injection of chemicals for corrosion inhibition, emulsion breaking, or hydrate control, among others.

The term "gas" is used interchangeably with "vapor," and means a substance or mixture of substances in the gaseous state as distinguished from the liquid or solid state. Likewise, the term "liquid" means a substance or mixture of substances in the liquid state as distinguished from the gas or solid state. As used herein, "fluid" is a generic term that may include either a gas or vapor.

A "hydrocarbon" is an organic compound that primarily includes the elements hydrogen and carbon although nitrogen, sulfur, oxygen, metals, or any number of other elements may be present in small amounts. As used herein, hydrocarbons generally refer to organic materials that are transported by pipeline, such as any form of natural gas or crude oil. A "hydrocarbon stream" is a stream enriched in hydrocarbons by the removal of other materials, such as water.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

The "Rankine cycle" is a thermodynamic cycle that is used to convert heat into work. The working fluid for the cycle is processed in a closed loop, which often includes a pump, wherein the pump increases the pressure of the working fluid. Moreover, heat is added to the working fluid at a constant pressure, wherein the heat may be supplied in the form of heat from a fired boiler, heat exhaust from a gas turbine, or heat from some other external heat source. This is known as isobaric heat addition. The next step of the cycle is isentropic expansion of the working fluid in an expander, or turbine, generating mechanical power. Isentropic expansion is an expansion process that does not involve an increase or decrease in the amount of entropy, or disorder, in the system. Heat may then be rejected from the working fluid at a constant pressure using a condenser, causing the working fluid to become a liquid. This is known as isobaric heat rejection.

As used herein, an "expander" refers to any unit, device, or apparatus that is capable of imposing a controlled decrease in pressure to a stream. This may include, for example, expansion turbines, valves, or two-phase expanders. Moreover, a "turbine" refers to a rotary engine or device that converts pressure energy of a fluid into shaft energy by expansion of the fluid. The shaft energy may be utilized for driving a compressor or generator for power generation.

"Bitumen" is a naturally-occurring heavy oil material. Generally, it is the hydrocarbon component found in oil sands. Bitumen can vary in composition depending upon the degree of loss of more volatile components. It can vary from a very viscous, tar-like, semi-solid material to a solid material. The hydrocarbon types found in bitumen can include aliphatics, aromatics, resins, and asphaltenes. Typical bitumen might be composed of: 19 wt. % aliphatics (which can range from 5 wt. %-30 wt. %, or higher); 19 wt. % asphaltenes (which can range from 5 wt. %-30 wt. %, or higher); 30 wt. % aromatics (which can range from 15 wt. %-50 wt. %, or higher); 32 wt. % resins (which can range from 15 wt. %-50 wt. %, or higher); and some amount of sulfur (which can range in excess of 7 wt. %). In addition, bitumen can contain some water and nitrogen compounds ranging from less than 0.4 wt. % to in excess of 0.7 wt. %.

A "bituminous feed" is a stream derived from oil sands that requires downstream processing in order to realize valuable bitumen products or fractions. A bituminous feed from oil sands is one that contains bitumen along with other undesirable components for removal in the process described herein. Such a bituminous feed may be derived directly from oil sands, and may be, for example, raw oil sands ore.

As used herein, the term "agglomerate" refers to a cluster, aggregate, collection, or mass. For example, an agglomerate may be formed by the nucleation, coalescence, layering, sticking, clumping, or fusing and sintering of various materials. Moreover, the term "agglomerator" may refer to a device that is configured to form such an agglomerate.

A "fractionator" is a separation device that includes a fractionation column, which is any type of distillation column that has a source of heat in the lower part of the column, such as a warm stream or a heating coil, and a drain for releasing heat at the top, such as a condenser or a cold stream. For example, a fractionator may include devices such as distillation columns, flash drums, rectification columns, stripping columns, and the like.

A "heat exchanger" is a device or system configured to transfer thermal energy between at least two distinct fluids. Exemplary heat exchanger types include co-current or counter-current heat exchangers, indirect heat exchangers (e.g. spiral wound heat exchangers or plate-fin heat exchangers), direct contact heat exchangers, or shell-and-tube heat exchangers, among others.

As used herein, a "separator" may be any mechanism or device which serves to separate a multiphase stream containing gas, liquid hydrocarbon, and in some cases also liquid water. Such a device may be a column which serves to separate multiple liquid and vapor streams, or may simply be a phase separator or flash drum in which a single multiphase stream is separated into its respective gas and liquid component streams. In some cases, a separator may be used to separate immiscible liquids, such as, for example, water and hydrocarbon liquids.

Overview

Embodiments disclosed herein provide methods and system that allow for the extraction of bitumen from oil sands using a solvent and the generation of power using the solvent recycled from the extraction process. The recycle solvent utilized in the power generation process may be a liquid recycle solvent or a vapor recycle solvent, or both. Moreover, the recycle solvent may be used as the working fluid in the power generation methods and system disclosed herein. Furthermore, in various embodiments, equipment for implementing a solvent circulating process for circulating and recycling solvent from an extraction process may incorporate equipment for implementing a Rankine cycle process for generating power from the solvent in a closed loop.

In some embodiments, the present techniques may be used in conjunction with a non-aqueous extraction (NAE) process for removing bitumen from oil sands. The NAE process may be utilized as an alternative to the hot water extraction process used commercially for oil sands. The NAE process may use less water than the hot water extraction process and can produce dry tailings that are easier to dispose of than the tailings produced from a hot water extraction process. The NAE process may utilize any of a number of solvents, such as, for example, cyclohexane, n-heptane, or toluene. The quantity of such solvent used for the NAE process may be relatively large, and the flow rate of the recycle solvent that is produced may be relatively high. For example, the flow rate of the recycle solvent may be on the order of 1,000-2,000 tonnes per hour. Thus, the recycle solvent may be used as the working fluid in the power generation system disclosed herein. Additionally, in some embodiments, the power that is generated may be used within the NAE process, or may be exported for sales.

FIG. 1 is a block diagram of a system 100 that may be used to extract bitumen from oil sands using an extraction process. The system 100 may also be used to generate power using non-aqueous solvent from the extraction process as the working fluid in a power generation process. The recycle solvent may include a vapor recycle solvent or a liquid recycle solvent, or both. The recycle solvent may be an organic solvent with a low boiling point, such for, for example, cyclohexane, toluene, hexane, or n-heptane, among others. In some embodiments, the use of low boiling point solvents advantageously permits recovery of the solvent with a lower energy requirement than would be expended for recovery of high boiling point solvents.

An extraction unit 102 within the system 100 may be configured to recover bitumen from oil sands. In various embodiments, the extraction unit 102 may employ solvent extraction and associated agglomeration of fine solids to simplify subsequent solid-liquid separation. The processes can produce at least one bitumen product with a quality specification of water and solids that exceeds downstream processing and pipeline transportation requirements and contains low levels of solids and water.

In various embodiments, any number of different subunits may be included in the extraction unit 102. Such subunits may include those disclosed by International Patent Publication No. WO2011/081734 and International Patent Publication No. WO2011/082209, which are incorporated herein by reference.

Once the bitumen has been extracted from the oil sands within the extraction unit 102, a dilbit stream 104 that was recovered from the extraction process may be flowed into a solvent recovery unit 106. As used herein, the term "dilbit," or diluted bitumen, may refer to a stream which consists of bitumen mixed with the non-aqueous solvent. Within the solvent recovery unit 106, the dilbit stream 104 may be separated into a solvent stream 108 and a bitumen extract stream 110. In some embodiments, the bitumen extract stream 110 may be flowed to a bitumen storage unit 112.

The solvent stream 108 may be circulated within the system 100 using, for example, a pump (not shown). For example, isentropic pumping may be performed in order to increase the pressure of the solvent stream 108. Moreover, the solvent stream 108 may be flowed into a heater 114. The heater 114 may include a boiler or other type of heat exchanger. In some embodiments, isobaric heat addition may be performed by adding heat to the solvent stream 108 in the heater 114 in order to produce a vapor stream 116.

From the heater 114, the vapor stream 116 may be flowed into an expander 118. The expander 118 may include an expander turbine, such as a gas turbine, that may be used to generate mechanical energy by spinning the turbine through isentropic expansion of the vapor stream 116. The mechanical energy can be used to generate power within a generator 120. Once power has been generated by the expander 118 using the vapor stream 116, the vapor stream 116 may be flowed into a cooler 122. In some embodiments, the cooler 122 may be a condenser or other type of heat exchanger. Within the cooler 122, isobaric cooling of the vapor stream 116 may be performed. The isobaric cooling may cause heat to be rejected from the vapor stream 116 to an external source, condensing the vapor stream 116 into a liquid solvent stream.

A portion 124 of the liquid solvent stream may be recirculated and reused as the working fluid for the system 100. Moreover, a portion of the liquid solvent stream may be stored within a storage unit (not shown) for future usage. Additionally, in some embodiments, a portion of the liquid solvent stream may be output from the system 100 as waste.

FIG. 1 is not intended to indicate that the system 100 is to include all of the components 102, 106, 112, 114, 118, 120, and 122 in every case. For example, in some embodiments, if the liquid solvent stream is recirculated and reused as the working fluid for the system 100, the cooler 122 may be eliminated. This may increase the efficiency of the system 100 by reducing the burden on the heater 114. Furthermore, any number of additional components not shown in FIG. 1 may be included within the system 100 according to the specific application. For example, in some embodiments, a power plant (not shown) may be coupled to the system 100 and may be used to provide exhaust heat to the heater 114.

Power Generation System

Figure 2:
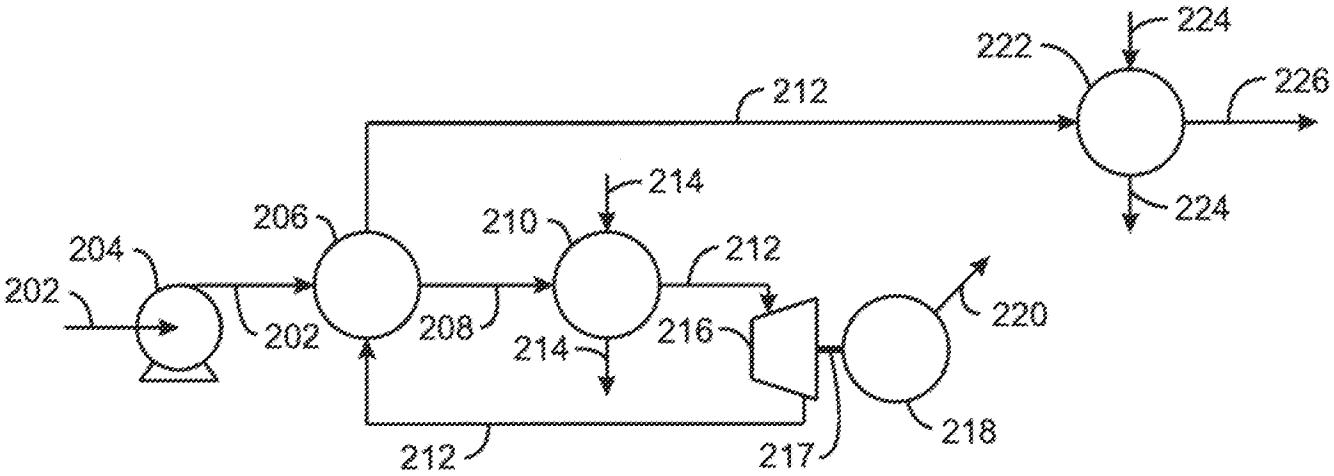
FIG. 2 is a schematic of a power generation system that utilizes liquid recycle solvent as the working fluid.

FIG. 2 is a schematic of a power generation system 200 that utilizes a liquid recycle solvent stream 202 as the working fluid. The liquid recycle solvent stream 202 is produced through condensation of a vapor recycle solvent stream into a liquid. The liquid recycle solvent stream 202 may be flowed into a pump 204 within the power generation system 200.

The pump 204 may send the liquid recycle solvent stream 202 into a first heat exchanger 206. Within the first heat exchanger 206, the liquid recycle solvent stream 202 may be heated by exchanging heat with another fluid of a higher temperature. The other fluid may include, for example, any type of liquid or vapor solvent, such as water, steam, a hot exhaust stream, or an organic solvent. Within the first heat exchanger 206, the liquid recycle solvent stream 202 may be converted into a high-temperature recycle solvent stream 208. The high-temperature recycle solvent stream 208 may be flowed from the first heat exchanger 206 to a second heat exchanger 210. Within the second heat exchanger 210, the liquid recycle solvent may be heated or superheated in order to produce a vapor recycle solvent stream 212. In various embodiments, the vaporization of the high-temperature recycle solvent stream 208 may be accomplished by exchanging heat with another fluid stream 214 of a higher temperature, which may also be flowed through the second heat exchanger 210.

The vapor recycle solvent stream 212 may be flowed from the second heat exchanger 210 to an expander 216. The expander 216 may be an expander turbine, such as, for example, a gas turbine or a liquid turbine. The expander 216 may include a rotor assembly, e.g., a rotating shaft 217 with attached blades. As the vapor recycle solvent stream 212 enters the expander 216, isentropic expansion of the vapor recycle solvent stream 212 may occur, turning the shaft 217. A power generator 218 coupled to the shaft 217 from the expander 216 may then be used to generate electric power 220 from the expansion of the recycle solvent. The power generator 218 may include, for example, an electric generator that converts mechanical power into the electric power 220. The generated electric power 220 may be sent to any of a number of locations. For example, the electric power may 220 be used to drive the system 200 or may be exported from the system 200 for sales purposes.

Once the vapor recycle solvent stream 212 exits the expander 216, it may be flowed into the first heat exchanger 206 as the hot fluid to preheat the liquid recycle solvent stream 202 forming the high-temperature recycle solvent stream 208. The exchange of heat between the vapor recycle solvent stream 212 and the liquid recycle solvent stream 202 may cool the vapor recycle solvent stream 212. After initial cooling, the vapor recycle solvent stream 212 may be flowed into a third heat exchanger 222. A cool fluid stream 224 such as water, cool solvent, and the like, may be flowed through the third heat exchanger 222. As the vapor recycle solvent stream 212 passes through the heat exchanger 222, the vapor recycle solvent stream 212 may be cooled and condensed back into a liquid recycle solvent stream 226. The liquid recycle solvent stream 226 may be flowed from the third heat exchanger 222 to an appropriate location. For example, the liquid recycle solvent stream 226 may be output from the power generation system 200 or recirculated and input back into the power generation system 200 at the pump 204.

Figure 3:
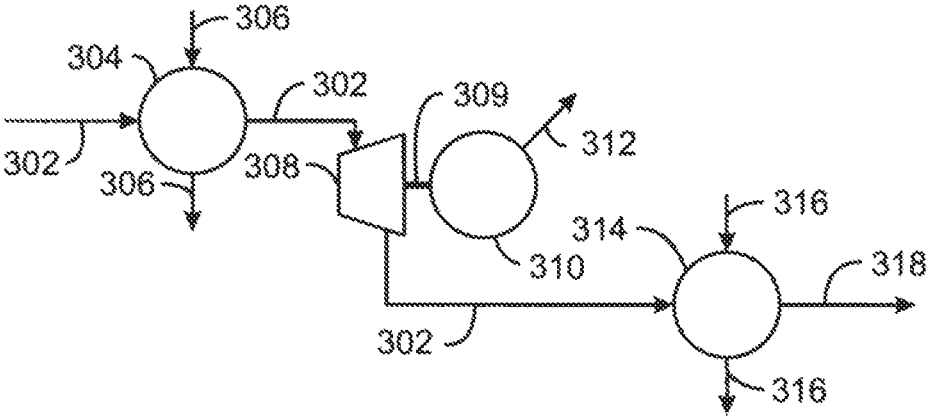
FIG. 3 is a schematic of a power generation system that utilizes vapor recycle solvent as the working fluid.

FIG. 3 is a schematic of a power generation system 300 that utilizes a vapor recycle solvent stream 302 as the working fluid. The vapor recycle solvent stream 302 may be a vaporized solvent that has been recycled from the separation of bitumen from the solvent. In various embodiments, the vapor recycle solvent stream 302 may be flowed into a first heat exchanger 304 within the power generation system 300. Within the first heat exchanger 304, the vapor recycle solvent stream 302 may be heated or superheated by exchanging heat with a heated or superheated fluid stream 306 that flows through the first heat exchanger 304. The heating or superheating of the vapor recycle solvent stream 302 within the first heat exchanger 304 may ensure that the vapor recycle solvent stream 302 remains in the gas phase and does not condense to a liquid. Additional heating of the stream may not be performed in some embodiments.

The vapor recycle solvent stream 302 may be flowed from the first heat exchanger 302 to an expander 308. The expander 308 may be an turbine, such as, for example, a gas turbine. The expander 308 may include a rotor assembly, e.g., a rotating shaft 309 with attached blades. As the vapor recycle solvent stream 302 enters the expander 308, isentropic expansion of the vapor recycle solvent stream 302 may occur, driving the turbine 308 and providing mechanical energy to the shaft 309. A power generator 310 coupled to the expander 308 may then be used to generate electric power 312 from the expansion of the vapor recycle solvent stream 302. The power generator 310 may include, for example, an electric generator that converts mechanical power into the electric power 312. The generated electric power 312 may be sent to any of a number of locations. For example, the electric power 312 may be used to drive the system 300 or may be exported from the system 300 for sales purposes.

Once the vapor recycle solvent stream 302 exits the expander 308, it may be flowed into a second heat exchanger 314. Within the second heat exchanger 314, the vapor recycle solvent stream 302 may be cooled by exchanging heat with a cooler fluid stream 316 that flows through the second heat exchanger 314. In some embodiments, the vapor recycle solvent stream 302 may be condensed into a liquid recycle solvent stream 318. The liquid recycle solvent stream 318 may be flowed from the second heat exchanger 314 to an appropriate location, such as to the extraction process.

Figure 4:
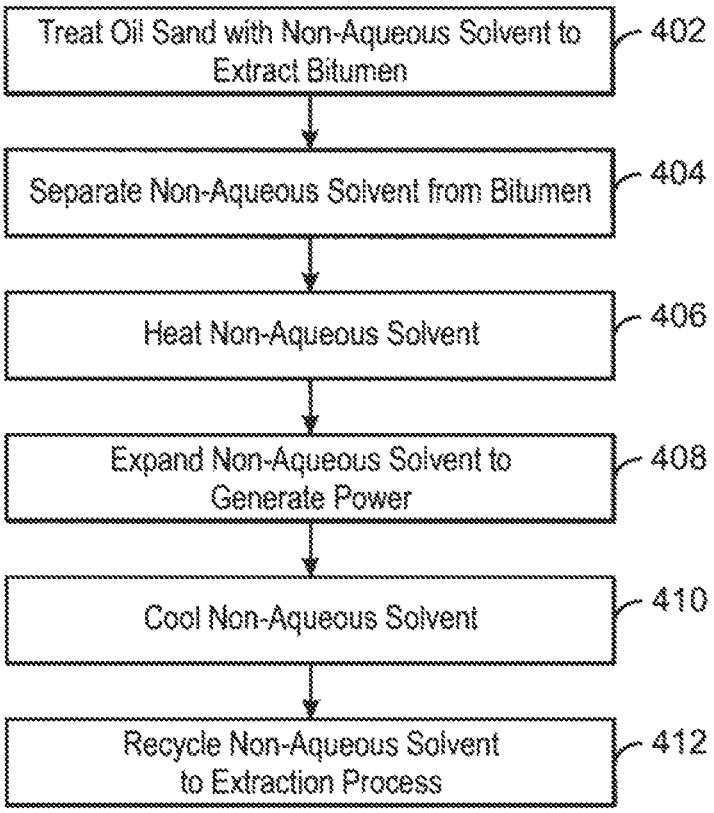
FIG. 4 is a process flow diagram showing a method for the extraction of bitumen from oil sands using non-aqueous solvent.

FIG. 4 is a process flow diagram showing a method 400 for the extraction of bitumen from oil sands using non-aqueous solvent. The method 400 may also be used for the generation of power using the non-aqueous solvent from the extraction process. In various embodiments, the non-aqueous solvent may be a cyclohexane solvent, a toluene solvent, a hexane solvent, or an n-heptane solvent, among others. Moreover, in some embodiments, at least a portion of the non-aqueous solvent may be a stream obtained from a facility, such as a production facility or a mining facility, among others.

The method begins at block 402 with the treatment of oil sands with non-aqueous solvent in order to extract bitumen. An extraction process, such as the extraction process carried out by the extraction unit 102 described with respect to FIG. 1, may be utilized for the treatment of the oil sands. Further, the extraction process may be any type of non-aqueous extraction process. For example, in some embodiments, the extraction process may include combining a first non-aqueous solvent and a bituminous feed from oil sands to form an initial slurry. The initial slurry may be separated into a fine solids stream and a coarse solids stream. The fine solids stream may be transformed into an agglomerated slurry within an agglomerator, wherein the agglomerated slurry includes agglomerates and a low-solids bitumen extract. The low-solids bitumen extract may be separated from the agglomerated slurry and subsequently mixed with a second solvent to form a solvent-bitumen low-solids mixture. In various embodiments, the second non-aqueous solvent may include a solvent that is the same as the first non-aqueous solvent, or that has a similar or lower boiling point than the first non-aqueous solvent.

The solvent-bitumen low-solids mixture may be subjected to gravity separation to produce a high-grade bitumen extract and a low-grade bitumen extract. At block 404, the non-aqueous solvent is separated from the bitumen. For example, a solvent recovery process may be used to remove the non-aqueous solvent from both the high-grade bitumen extract and the low-grade bitumen extract, producing a low-grade bitumen product and a high-grade bitumen product. The non-aqueous solvent may then be utilized as the working fluid for a power generation process beginning at block 406.

In various embodiments, the non-aqueous solvent may be accepted from the solvent recovery process and circulated using a pump. The pump may be also be used to increase the pressure of the non-aqueous solvent through an isentropic pumping process. The pump may be, for example, a centrifugal pump or an axial pump, among others. The non-aqueous solvent obtained from the solvent recovery process may also be cleaned using a solvent treating process in order to prepare the non-aqueous solvent for the power generation process.

At block 406, the non-aqueous solvent is heated. The heating may be performed using a boiler, wherein the boiler may include a hydrocarbon-fired, gas turbine waste heat recovery unit or a heat exchanger, among others. Any stream hotter than the solvent stream may be used to heat the solvent stream. Heat integration to maximize the overall process thermal efficiency is an important design consideration. The heating may also be performed by multiple boilers, or heat exchangers. For example, the non-aqueous solvent may be heated in one heat exchanger and superheated in a subsequent heat exchanger. In various embodiments, the non-aqueous solvent may be a vapor that is heated or superheated. The temperature of the non-aqueous solvent may be such that the solvent will remain in the gas phase throughout the power generation step at block 408.

The non-aqueous solvent may be heated within the boiler using exhaust heat from an electric power plant. In some embodiments, exhaust heat generated by a gas turbine may be used to at least partially heat the non-aqueous solvent. This may be accomplished, for example, by supplementally firing the gas turbine in order to generate exhaust heat.

At block 408, the non-aqueous solvent is expanded to generate power. This may be accomplished, for example, using an expander turbine. Within the expander turbine, the pressure of the non-aqueous solvent may be decreased, and mechanical power may be generated, turning the shaft of the expander turbine. In various embodiments, an electric generator may be mechanically coupled to the shaft of the expander turbine and may be used to convert the generated mechanical power into electric power. Moreover, any number of other components, such as a gas compressor or a pump, may also be mechanically coupled to the shaft of the expander turbine.

In some embodiments, waste process heat generated from a solvent circulating process may be added to the non-aqueous solvent as it enters the expander turbine. This may increase the amount of power generated within the expander turbine, as well as ensure that the non-aqueous solvent remains in the gas phase as it passes through the expander turbine. Additionally, in various embodiments, the amount of power generated by expanding the non-aqueous solvent may be increased through the implementation of a reheating process, a superheating process, or a regeneration process, or any combinations thereof.

In various embodiments, the power generated by expanding the non-aqueous solvent may be used to power equipment associated with the extraction process, the solvent recovery process, or the solvent circulating process. Moreover, the power may also be used to power equipment associated with a hydrocarbon production facility or a mining facility, among others. Furthermore, the power may be used for any number of other applications or uses.

At block 410, the non-aqueous solvent is cooled. The cooling of the non-aqueous solvent may be performed using a heat exchanger or cooler, such as a condenser, an aerial cooler, or a seawater cooler. In various embodiments, the cooling of the non-aqueous solvent may reduce the temperature of the solvent such that it reenters the liquid phase. In some embodiments, at least some of the heat rejected from the cooler may be used for the solvent circulating process, the solvent treatment process, or a freeze protection process, among others. For example, in some embodiments, the freeze protection process may circulate warm solvent to prevent pipes from freezing. This is also known as "heat tracing."

At block 412, at least a portion of the non-aqueous solvent is recycled to the extraction process. The recycled non-aqueous solvent may then be reused for the extraction of bitumen from oil sands and the generation of power according to the method 400. Additionally, in some embodiments, portions of the non-aqueous solvent may be flowed to any of a number of locations. For example, one portion of the non-aqueous solvent may be stored for future usage, while another portion of the non-aqueous solvent may be rejected as a waste product.

It should be noted that the process flow diagram is not intended to indicate that the steps of method 400 must be executed in any particular order or that every step must be included for every case. Moreover, additional steps may be included which are not shown in FIG. 4. Furthermore, in some embodiments, the method 400 may be used in conjunction with a variety of solvent circulating processes in addition to non-aqueous extraction processes. For example, the method 400 may be used in conjunction with paraffinic froth treatment (PFT) processes, high-temperature paraffinic froth treatment (HT-PFT) processes, or solvent deasphalting processes, among others.

Exemplary Bitumen Extraction and Power Generation Systems

Figure 5:
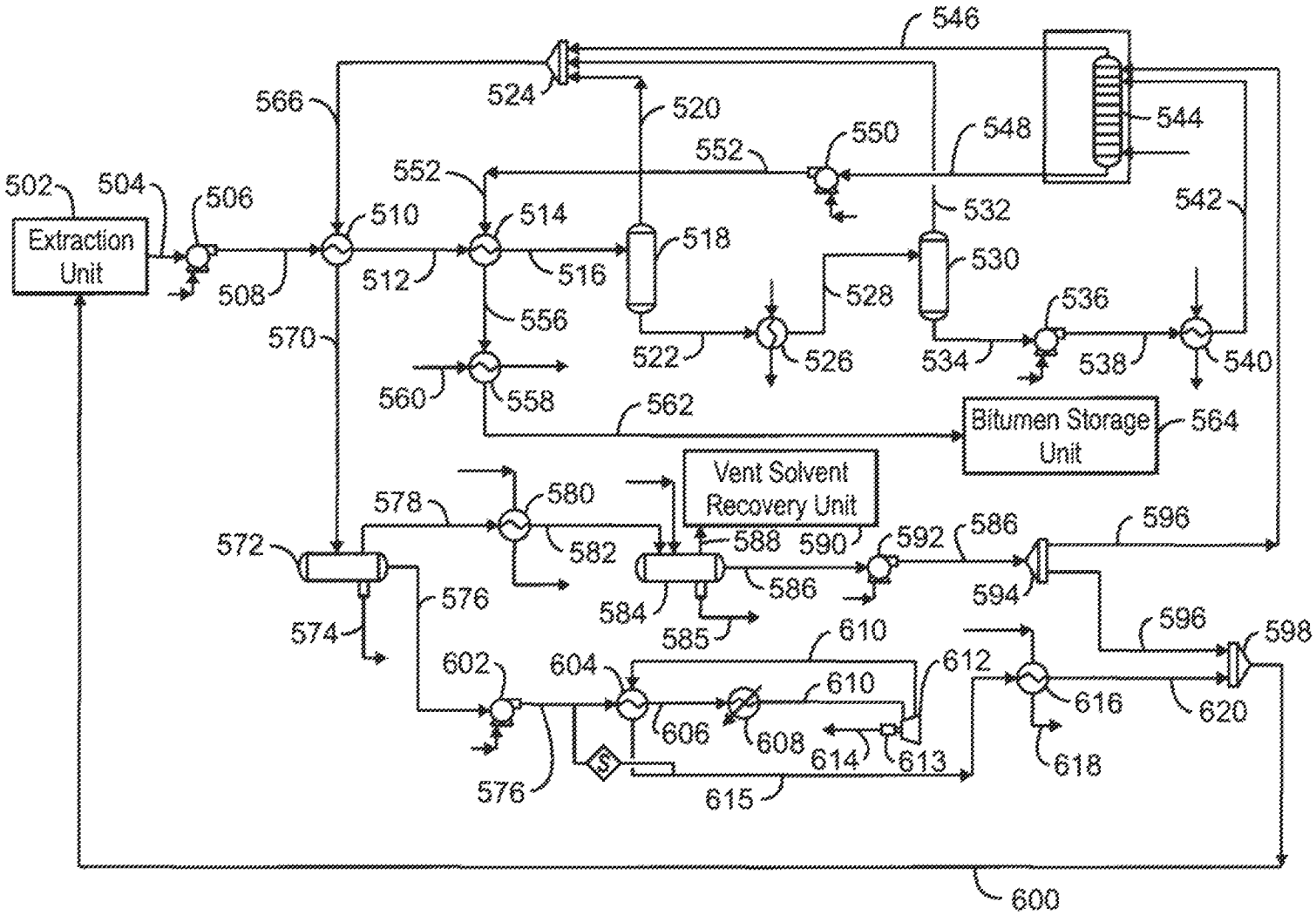
FIG. 5 is a schematic of a system that utilizes liquid recycle solvent from a non-aqueous extraction (NAE) process as the working fluid within a power generation process.

FIG. 5 is a schematic of a system 500 that utilizes liquid recycle solvent from a non-aqueous extraction (NAE) process as the working fluid within a power generation process. In various embodiments, the system 500 may include an extraction unit 502. Within the extraction unit 502, a non-aqueous solvent is used to separate bitumen from oil sands in an extraction process. The product obtained from the extraction process is termed "dilbit," which consists of bitumen mixed with the non-aqueous solvent. The non-aqueous solvent may be, for example, cyclohexane, toluene, n-heptane, or hexane, among others. It can be understood that the exemplary system shown below is only one configuration that can be used. Any number of other arrangements can be used to generate power using a solvent stream in a bitumen extraction process.

A dilbit stream 504 obtained from the extraction process is flowed from the extraction unit 502 to a pump 506. The pump 506 may be, for example, a centrifugal pump or an axial pump. The pump 506 increases the pressure of the dilbit stream 504 to produce a high-pressure dilbit stream 508 though a pumping process. The high-pressure dilbit stream 508 is then be flowed into a first heat exchanger 510. In some embodiments, the first heat exchanger 510 may be, for example, a boiler, a waste heat recovery unit, or a heat exchanger, or any combinations thereof.

Within the first heat exchanger 510, the temperature of the high-pressure dilbit stream 508 is increased through a heating process. In some embodiments, the first heat exchanger 510 heats the high-pressure dilbit stream 508 to the boiling point of the non-aqueous solvent, producing a partially-vaporized dilbit stream 512. The partially-vaporized dilbit stream 512 is then flowed into a second heat exchanger 514. Within the second heat exchanger 514, the partially-vaporized dilbit stream 512 is further heated, and may be superheated, to produce a high-temperature dilbit stream 516. In some embodiments, the high-temperature dilbit stream 516 is partially or fully vaporized, depending on the concentrations of the solvent and the bitumen within the high-temperature dilbit stream 516.

The high-temperature dilbit stream 516 is flowed into a first flash drum 518. The first flash drum 518 produces a first vapor solvent stream 520 and a dilbit stream 522 through a first-stage separation process. The dilbit stream 522 will have a higher bitumen concentration than the high-temperature dilbit stream 516, since a portion of the solvent has been extracted from the dilbit stream 522 in the form of the first vapor solvent stream 520. The first vapor solvent stream 520 is flowed from the first flash drum 518 to a mixer 524. The dilbit stream 522 is flowed into a third heat exchanger 526.

The third heat exchanger 526 further increases the temperature of the dilbit stream 522, producing a high-temperature dilbit stream 528. In some embodiments, the high-temperature dilbit stream 528 is partially or fully vaporized, depending on the concentrations of the solvent and the bitumen within the high-temperature dilbit stream 528. The high-temperature dilbit stream 528 is then flowed into a second flash drum 530.

The second flash drum 530 produces a second vapor solvent stream 532 and a high-concentration dilbit stream 534 through a second-stage separation process. The high-concentration dilbit stream 534 will have a higher bitumen concentration than the high-temperature dilbit stream 528, since a portion of the solvent has been extracted from the high-concentration dilbit stream 534 in the form of the second vapor solvent stream 532. The second vapor solvent stream 532 is flowed from the second flash drum 530 to the mixer 524. The high-concentration dilbit stream 534 is flowed through a pump 536.

The pump 536 increases the pressure of the high-concentration dilbit stream 534, producing a high-pressure dilbit stream 538. The high-pressure dilbit stream 538 is flowed into a fourth heat exchanger 540. The fourth heat exchanger 540 increases the temperature of the high-pressure dilbit stream 538, producing a high-temperature dilbit stream 542, in preparation for a final stage of separation. The high-temperature dilbit stream 542 is then flowed into a fractionation column 544.

Within the fractionation column 544, the high-temperature dilbit stream 542 is separated into a third vapor solvent stream 546 and a bitumen stream 548 in the final stage of separation of the solvent from the bitumen. The bitumen stream 546 is then flowed from the fractionation column 544 through a pump 550, producing a high-pressure bitumen stream 552. In some embodiments, the high-pressure bitumen stream 552 is flowed through the second heat exchanger 514 and acts as the source of heat for increasing the temperature of the partially-vaporized dilbit stream 512 within the second heat exchanger 514. For example, the high-pressure bitumen stream 552 transfers heat to the partially-vaporized dilbit stream 512, producing a reduced-temperature bitumen stream 556. The reduced-temperature bitumen stream 556 may then flow through a fifth heat exchanger 558. Within the fifth heat exchanger 558, the reduced-temperature bitumen stream 556 is cooled by exchanging heat with a cooler water stream 560 flowing through the fifth heat exchanger 558, producing a bitumen product stream 562. The bitumen product stream 562 may be flowed to a bitumen storage unit 564, wherein the bitumen product stream 562 may be stored or exported for sales.

The mixer 524 combines the first vapor solvent stream 520, the second vapor solvent stream 532, and the third vapor solvent stream 546 to produce a vapor solvent stream 566. In some embodiments, the vapor solvent stream 566 is flowed through the first heat exchanger 510 and acts as the source of heat for increasing the temperature of the high-pressure dilbit stream 508 within the first heat exchanger 510. For example, the vapor solvent stream 566 transfers heat to the high-pressure dilbit stream 508. Due to the loss of heat to the high-pressure dilbit stream 508, the vapor solvent stream 566 may be condensed, producing a saturated liquid solvent stream 570.

The saturated liquid solvent stream 570 may be flowed into a first fractionator 572. Within the first fractionator 572, the saturated liquid solvent stream 570 may be flashed, or partially evaporated, in a single-stage flash process. The flashing of the saturated liquid solvent stream 570 causes the saturated liquid solvent stream 570 to be separated into a water stream 574, a liquid solvent stream 576, and a vapor solvent stream 578.

The vapor solvent stream 578 is flowed through a sixth heat exchanger 580. Within the sixth heat exchanger 580, the vapor solvent stream 578 is cooled and condensed, producing a liquid solvent stream 582, in preparation for a second-stage flash process. The liquid solvent stream 582 is flowed into a second fractionator 584, wherein the liquid solvent stream 582 is flashed in the second-stage flash process to produce a water stream 585, a liquid recycle solvent stream 586, and a vapor recycle solvent stream 588.

The vapor recycle solvent stream 588 is flowed to a vent solvent recovery unit 590. In some embodiments, the vent solvent recovery unit 590 may utilize the vapor recycle solvent stream 588 to generate power using an expander turbine coupled to an electric generator. Moreover, the vent solvent recovery unit 590 may convert the vapor recycle solvent stream 588 into a form that is suitable for recycle or reuse within the system 500.

The liquid recycle solvent stream 586 is flowed through a pump 592, which increases the pressure and flow rate of the liquid recycle solvent stream 586. The liquid recycle solvent stream 586 is then flowed into a y-pipe 594. Within the y-pipe 594, the liquid recycle solvent stream 586 is separated into two recycle solvent streams 596. In some embodiments, one of the recycle solvent streams 596 is flowed back to the fractionation column 544 to assist in the separation as a reflux stream, while the other one of the recycle solvent streams 596 is mixed with one or more other recycle solvent streams within a mixer 598 to produce a final recycle solvent stream 600. In some embodiments, the final recycle solvent stream 600 is flowed back to the extraction unit 502 to be used in the extraction of the bitumen from the oil sands.

In various embodiments, the liquid solvent stream 576 is flowed from the first fractionator 572 to a pump 602, which may increase the pressure and flow rate of the liquid solvent stream 576. The liquid solvent stream 576 is flowed into a seventh heat exchanger 604. Within the seventh heat exchanger 604, the liquid solvent stream 576 is heated to produce a high-temperature solvent stream 606. In some embodiments, the high-temperature solvent stream 606 is partially or fully vaporized. The high-temperature solvent stream 606 is flowed into an eighth heat exchanger 608, in which the high-temperature solvent stream 606 is heated, and may be superheated, producing a vapor solvent stream 610. The temperature of the vapor solvent stream 610 may be such that the vapor solvent stream 610 remains in the gas phase at it flows through an expander turbine 612. The expander turbine 612 may be a centrifugal or axial machine, such as, for example, a gas turbine. In various embodiments, mechanical power may be produced in a power generation process through the isentropic expansion of the vapor solvent stream 610 within the expander turbine 612, turning a shaft. In some embodiments, an electric generator 613 is mechanically coupled to the shaft of the expander turbine 612 and converts the generated mechanical power to electric power 614.

Once the vapor solvent stream 610 passes through the expander turbine 612, the vapor solvent stream 610 is flowed through the seventh heat exchanger 604 and acts as the heat source for increasing the temperature of the liquid solvent stream 576, producing a solvent stream 615. The solvent stream 615 may be in the gas phase or the liquid phase, depending on the amount of heat lost to the liquid solvent stream 576. The solvent stream 615 is flowed through a ninth heat exchanger 616. Within the ninth heat exchanger 616, the solvent stream 615 is cooled and condensed by exchanging heat with a cool water stream 618, producing a recycle solvent stream 620. The recycle solvent stream 620 is mixed with the other recycle solvent stream 596 within the mixer 598 to produce the final recycle solvent stream 600. As discussed above, the final recycle solvent stream 600 can then be flowed back to the extraction unit 502.

TABLE 1

Power Generation Using Liquid Recycle Solvent

| | | Case | | | | | |
|---|---|---|---|---|---|---|---|
| | Base | 1 | 2 | 3 | 4 | 5 | 6 |
| Pressure Before Expansion (bara) | 5.6 | 15 | 20 | 25 | 30 | 35 | 40 |
| Temperature Before Expansion (° C.) | 124.7 | 226.3 | 244.2 | 259.3 | 272.3 | 283.8 | 293.8 |
| Temperature After Expansion (° C.) | | 202.9 | 212.4 | 220.2 | 226.4 | 231.4 | 235.1 |
| Pressure After Expansion (bara) | | 5.6 | 5.6 | 5.6 | 5.6 | 5.6 | 5.6 |
| Expander Turbine Power (MW) | | 7.95 | 10.34 | 12.19 | 13.68 | 14.91 | 15.92 |
| Pump Power (MW) | 0.05 | 0.59 | 0.85 | 1.11 | 1.37 | 1.63 | 1.89 |
| Heat Exchanger Duty (GJ/hr) | | 144 | 194 | 193 | 246 | 233 | 225 |
| Heater Duty (GJ/hr) | | 331 | 309 | 332 | 297 | 324 | 343 |
| Cooler Duty (GJ/hr) | 140 | 444 | 415 | 432 | 432 | 416 | 433 |
| Net Power (MW) | | 7.40 | 9.53 | 11.13 | 12.36 | 13.33 | 14.08 |

Figure 6:
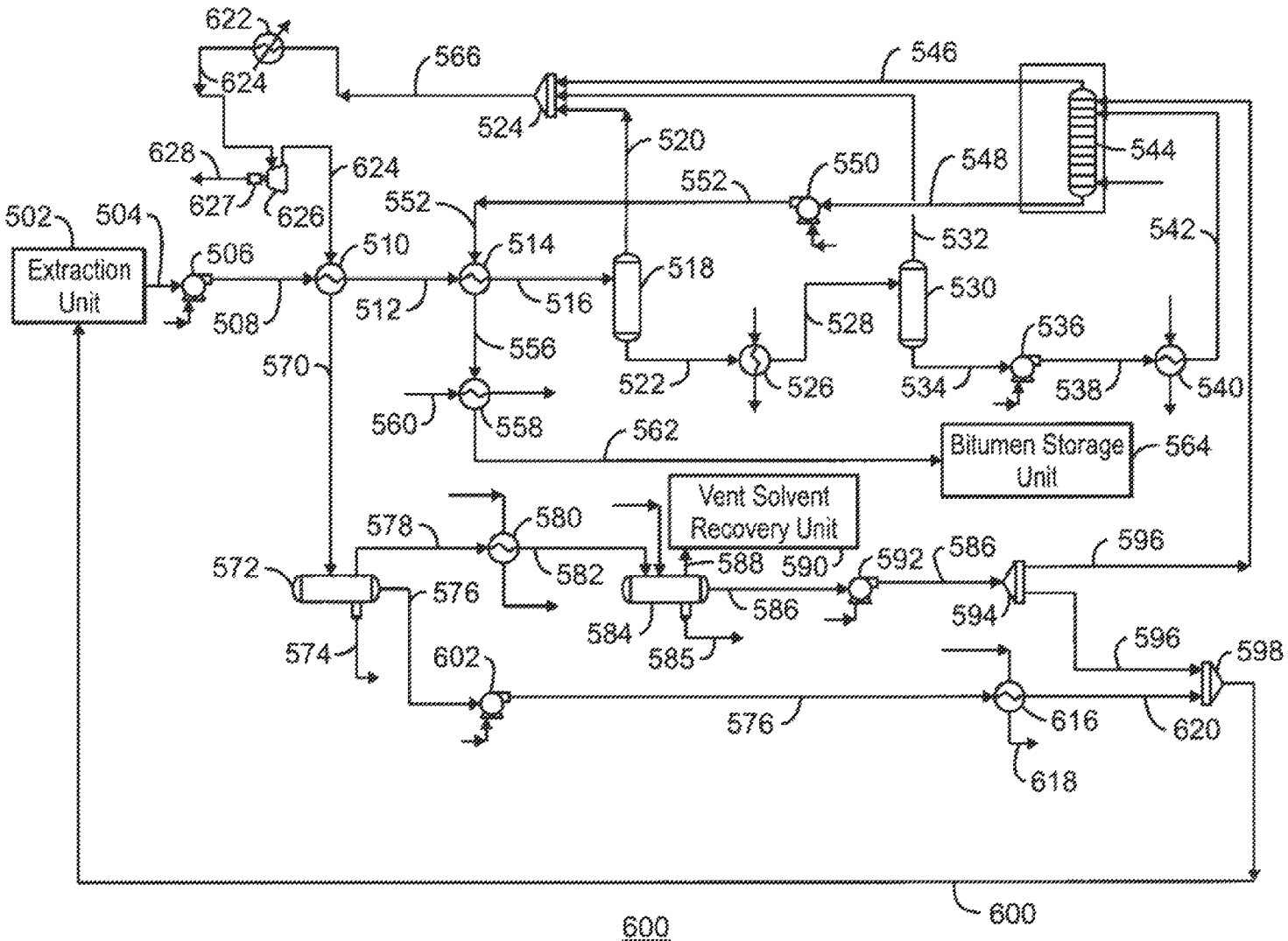
FIG. 6 is a schematic of a system that utilizes vapor recycle solvent from a NAE process as the working fluid within a power generation process.

Table 1 shows net power generation results for a number of cases of the system 500. For the base case, the liquid recycle solvent is pumped to a pressure of 5.6 bara to permit passage through downstream equipment. The stream is returned to that pressure after expansion. For cases 1-6, the pressure that the liquid recycle solvent is pumped to before expansion is incrementally increased. Table 1 shows the net power generation for each case, wherein the net power generation is the power generated by the expander turbine minus the power required by the pump. As shown in Table 1, the net power generation increases as the pressure before expansion is increased. The process conditions shown in Table 1 are merely intended to be examples of conditions that may be found in a plant, as determined by simulations. The actual conditions may be significantly different and may vary significantly from the conditions shown FIG. 6 is a schematic of a system 600 that utilizes vapor recycle solvent from a NAE process as the working fluid within a power generation process. Like numbered items are as described with respect to FIG. 5. The system 600 may be used to extract bitumen from oil sands using the extraction unit 502 and separate the resulting dilbit into the bitumen product stream 562 and the final recycle solvent stream 600 in the same manner as described with respect to the system 500. However, the power generation process according to the system 600 differs from the power generation process described with respect to the system 500. Specifically, within the system 600, power is generated using the vapor solvent stream 566 instead of the liquid solvent stream 582. As noted with respect to FIG. 5, the configuration in FIG. 6 is exemplary. It can be understood that any number of variations may be made while generating power from a recycled solvent vapor stream.

In various embodiments, the vapor solvent stream 566 is flowed into a heat exchanger 622. Within the heat exchanger 622, the vapor solvent stream 566 is heated, and may be superheated, to produce a superheated vapor solvent stream 624. The temperature of the superheated vapor solvent stream 624 may be such that the superheated vapor solvent stream 624 will remain in the gas phase throughout the power generation process.

In various embodiments, mechanical power is produced in a power generation process through the isentropic expansion of the superheated vapor solvent stream 624 within an expander turbine 626, which turns a shaft. Moreover, in some embodiments, an electric generator 627 may be mechanically coupled to the shaft of the expander turbine 626 and configured to convert the generated mechanical power to electric power 628. After the superheated vapor solvent stream 624 passes through the expander turbine 626, the superheated vapor solvent stream 624 may be flowed through the first heat exchanger 510 to provide the heat source for increasing the temperature of the high-pressure dilbit stream 508. In some embodiments, the superheated vapor solvent stream 624 is condensed due to the loss of heat within the first heat exchanger 510, producing the saturated liquid solvent stream 570.

TABLE 2

Power Generation Using Vapor Recycle Solvent

| | | Case | |
|---|---|---|---|
| | Base | 1 | 2 |
| Pressure Before Expansion (bara) | 4.95 | 4.20 | 4.20 |
| Temperature Before Expansion (° C.) | 149.9 | 160 | 170 |
| Temperature After Expansion (° C.) | | 141.8 | 152.0 |
| Pressure After Expansion (bara) | | 1.71 | 1.71 |
| Expander Turbine Power (MW) | | 13.82 | 14.93 |
| Heater Duty (GJ/hr) | | 40.0 | 79.3 |
| First Heat Exchanger Duty (GJ/hr) | 374 | 420 | 420 |
| Second Heat Exchanger Duty (GJ/hr) | 177 | 126 | 126 |

Table 2 shows net power generation results for a number of cases of the system 600. For the base case, the temperature before expansion is 149.9° C. For cases 1 and 2, the temperature before expansion is increased to 160° C. and 170° C., respectively. For the system 600, the pressure after expansion is set to 1.71 bara in order to avoid sub-atmospheric pressure in downstream equipment. As shown in Table 2, the power generated by the expander turbine increases as the temperature before expansion is increased. The process conditions shown in Table 2 are merely intended to be examples of conditions that may be found in a plant, as determined by simulations. The actual conditions may be significantly different and may vary significantly from the conditions shown.

While the present techniques may be susceptible to various modifications and alternative forms, the exemplary embodiments discussed above have been shown only by way of example. However, it should again be understood that the technique is not intended to be limited to the particular embodiments disclosed herein. Indeed, the present techniques include all alternatives, modifications, and equivalents falling within the true spirit and scope of the appended claims.

EMBODIMENTS

Embodiments of the invention may include any combinations of the methods and systems shown in the following numbered paragraphs. This is not to be considered a complete listing of all possible embodiments, as any number of variations can be envisioned from the description above.

1. A method for power generation using non-aqueous solvent, including:

treating oil sands with a non-aqueous solvent to extract bitumen in an extraction process;

separating the non-aqueous solvent from the bitumen in a solvent recovery process;

heating the non-aqueous solvent;

expanding the non-aqueous solvent to generate power;

cooling the non-aqueous solvent; and recycling at least a portion of the non-aqueous solvent to the extraction process.

2. The method of paragraph 1, including accepting the non-aqueous solvent from the solvent recovery process and circulating the non-aqueous solvent using a pump.
3. The methods of paragraphs 1 or 2, including adding waste process heat generated from a solvent circulating process to the non-aqueous solvent before it enters an expander turbine.
4. The methods of any of paragraphs 1, 2, or 3, including heating the non-aqueous solvent in a first heat exchanger.
5. The methods of any of the preceding paragraphs, including cooling the non-aqueous solvent in a second heat exchanger.
6. The method of paragraph 5, including using at least some heat rejected from the second heat exchanger for a solvent circulating process, a solvent treatment process, or a freeze protection process, or any combinations thereof.
7. The methods of any of paragraphs 1-5, including heating the non-aqueous solvent using exhaust heat from an electric power plant.
8. The methods of any of paragraphs 1-5, or 7, including expanding the non-aqueous solvent to generate power using an expander turbine.
9. The methods of any of paragraphs 1-5, 7, or 8, including cleaning the non-aqueous solvent using a solvent treating process.
10. The methods of any of paragraphs 1-5 or 7-9, including powering equipment associated with the extraction process, the solvent recovery process, a solvent circulating process, a hydrocarbon production facility, or a mining facility, or any combinations thereof, using the power generated by expanding the non-aqueous solvent.
11. A system for power generation using non-aqueous solvent, including:

an extraction unit configured to extract bitumen from oil sands by treating the oil sands with a non-aqueous solvent;

a solvent recovery unit configured to separate the non-aqueous solvent from the bitumen;

a first heat exchanger configured to heat the non-aqueous solvent;

an expander configured to generate power by turning an expander turbine using the non-aqueous solvent; and a second heat exchanger configured to cool the non-aqueous solvent.

12. The system of paragraph 11, including a pump configured to circulate the non-aqueous solvent using a solvent circulating process.
13. The systems of paragraphs 11 or 12, wherein the non-aqueous solvent includes a liquid recycle solvent.
14. The systems of any of paragraphs 11, 12, or 13, wherein the non-aqueous solvent includes a vapor recycle solvent.
15. The systems of any of the preceding paragraphs, wherein the first heat exchanger includes a boiler, a waste heat recovery unit, or a heat exchanger, or any combinations thereof.
16. The systems of any of the preceding paragraphs, wherein the second heat exchanger includes a condenser, an aerial cooler, or a seawater cooler, or any combinations thereof.

17. The systems of any of the preceding paragraphs, wherein the non-aqueous solvent includes a cyclohexane stream, a toluene stream, a hexane stream, an n-heptane stream, or any combinations thereof.

18. The systems of any of the preceding paragraphs, including an electric generator, a gas compressor, or a pump, or any combinations thereof, mechanically coupled to the expander turbine.

19. The systems of any of the preceding paragraphs, including a hydrocarbon production facility or a mining facility, or any combination thereof, which utilizes the power generated by the turning of the expander turbine.

20. The systems of any of the preceding paragraphs, wherein a stream from a hydrocarbon production facility or a mining facility, or any combination thereof, includes at least a part of the non-aqueous solvent.

21. The systems of any of the preceding paragraphs, including a power plant coupled to the system and configured to at least partially provide power to the system.

22. The systems of any of the preceding paragraphs, wherein the non-aqueous solvent includes a recycle solvent from a non-aqueous extraction process.

23. The systems of any of the preceding paragraphs, including any number of additional heat exchangers configured to heat or cool the non-aqueous solvent.

24. A method for power generation using non-aqueous solvent, including:

extracting bitumen from oil sands by treating the oil sands with a non-aqueous solvent;

recovering the non-aqueous solvent by separating the non-aqueous solvent from the bitumen;

heating the non-aqueous solvent to produce a dry vapor;

decreasing the pressure of the dry vapor to obtain an expanded dry vapor;

generating power from the expanded dry vapor; and cooling the dry vapor to recover the non-aqueous solvent.

25. The method of paragraph 24, including using a reheating process, a superheating process, or a regeneration process, or any combinations thereof, to increase an amount of generated power.

What is claimed is:

1. A method for power generation using non-aqueous solvent, comprising:

treating oil sands with a non-aqueous solvent to extract bitumen in an extraction process;

separating the non-aqueous solvent from the bitumen in a solvent recovery process;

heating all of the separated non-aqueous solvent;

expanding all of the heated non-aqueous solvent to generate power;

cooling all of the expanded non-aqueous solvent; and recycling at least a portion of the cooled non-aqueous solvent to the extraction process.

2. The method of claim 1, comprising accepting the non-aqueous solvent from the solvent recovery process and circulating the separated non-aqueous solvent using a pump.

3. The method of claim 1, wherein heating all of the separated non-aqueous solvent comprises adding waste process heat generated from a solvent circulating process to the separated non-aqueous solvent before it enters an expander turbine.

4. The method of claim 1, wherein heating all of the separated non-aqueous solvent is accomplished using a first heat exchanger.

5. The method of claim 1, wherein cooling all of the expanded non-aqueous solvent is accomplished using a second heat exchanger.

6. The method of claim 5, comprising using at least some heat rejected from the second heat exchanger for a solvent circulating process, a solvent treatment process, or a freeze protection process, or any combinations thereof.

7. The method of claim 1, wherein heating all of the separated non-aqueous solvent is accomplished using exhaust heat from an electric power plant.

8. The method of claim 1, wherein expanding all of the non-aqueous solvent to generate power is accomplished using an expander turbine.

9. The method of claim 1, further comprising cleaning all of the separated non-aqueous solvent using a solvent treating process.

10. The method of claim 1, comprising powering equipment associated with the extraction process, the solvent recovery process, a solvent circulating process, a hydrocarbon production facility, or a mining facility, or any combinations thereof, using the power generated by expanding all of the non-aqueous solvent.

11. A system for power generation using non-aqueous solvent, comprising:

an extraction unit configured to extract bitumen from oil sands by treating the oil sands with a non-aqueous solvent;

a solvent recovery unit configured to separate the non-aqueous solvent from the bitumen;

a first heat exchanger configured to heat all of the non-aqueous solvent separated by the solvent recovery unit;

an expander configured to generate power by turning an expander turbine using the heated non-aqueous solvent; and a second heat exchanger configured to cool the non-aqueous solvent after the non-aqueous solvent has exited the expander.

12. The system of claim 11, comprising a pump configured to circulate the separated non-aqueous solvent using a solvent circulating process.

13. The system of claim 11, wherein the non-aqueous solvent comprises a liquid recycle solvent.

14. The system of claim 11, wherein the non-aqueous solvent comprises a vapor recycle solvent.

15. The system of claim 11, wherein the first heat exchanger comprises a boiler, a waste heat recovery unit, or a heat exchanger, or any combinations thereof.

16. The system of claim 11, wherein the second heat exchanger comprises a condenser, an aerial cooler, or a seawater cooler, or any combinations thereof.

17. The system of claim 11, wherein the non-aqueous solvent comprises a cyclohexane stream, a toluene stream, a hexane stream, an n-heptane stream, or any combinations thereof.

18. The system of claim 11, comprising an electric generator, a gas compressor, or a pump, or any combinations thereof, mechanically coupled to the expander turbine.

19. The system of claim 11, comprising a hydrocarbon production facility or a mining facility, or any combination thereof, which utilizes the power generated by the turning of the expander turbine.

20. The system of claim 11, wherein a stream from a hydrocarbon production facility or a mining facility, or any combination thereof, comprises at least a part of the non-aqueous solvent.

21. The system of claim 11, comprising a power plant coupled to the system and configured to at least partially provide power to the system.

22. The system of claim 11, wherein the non-aqueous solvent comprises a recycle solvent from a non-aqueous extraction process.

23. The system of claim 11, comprising any number of additional heat exchangers configured to heat or cool the non-aqueous solvent.

24. A method for power generation using non-aqueous solvent, comprising:

extracting bitumen from oil sands by treating the oil sands with a non-aqueous solvent;

recovering the non-aqueous solvent by separating the non-aqueous solvent from the bitumen;

heating all of the recovered non-aqueous solvent to produce a dry vapor;

decreasing the pressure of the dry vapor to obtain an expanded dry vapor;

generating power from the expanded dry vapor; and cooling the dry vapor to recover the non-aqueous solvent.

25. The method of claim 24, comprising using a reheating process, a superheating process, or a regeneration process, or any combinations thereof, to increase an amount of generated power.

* * * * *